United States Patent [19]

O'Neill

[11] Patent Number: 4,724,801

[45] Date of Patent: Feb. 16, 1988

[54] HYDRAULIC VALVE-OPERATING SYSTEM FOR INTERNAL COMBUSTION ENGINES

[75] Inventor: Cormac G. O'Neill, Walnut Creek, Calif.

[73] Assignee: Olin Corporation, Stamford, Conn.

[21] Appl. No.: 3,629

[22] Filed: Jan. 15, 1987

[51] Int. Cl.[4] ..... F01L 9/02

[52] U.S. Cl. ..... 123/90.12; 123/90.11; 123/90.14

[58] Field of Search ..... 123/90.11, 90.12, 90.13, 123/90.14

[56] References Cited

U.S. PATENT DOCUMENTS

| | | | |
|---|---|---|---|
| 2,827,884 | 3/1958 | Stivender | 123/90.12 |
| 2,962,013 | 11/1960 | Reggio | 123/90.12 |
| 3,738,337 | 6/1973 | Massie | 123/90.11 |
| 3,995,606 | 12/1976 | Firey | 123/90.12 |
| 4,231,543 | 11/1980 | Zürner et al. | 123/90.12 |
| 4,296,911 | 10/1981 | Escobosa | 123/90.12 |

FOREIGN PATENT DOCUMENTS

| | | | |
|---|---|---|---|
| 2552492 | 3/1985 | France | 123/90.11 |
| 170414 | 9/1984 | Japan | 123/90.12 |
| 188016 | 10/1984 | Japan | 123/90.12 |

*Primary Examiner*—Ira S. Lazarus

*Attorney, Agent, or Firm*—Bruce E. Burdick

[57] ABSTRACT

A fluidic valve-operating system has a reciprocally-movable plunger for moving a valve of an internal combustion engine between closed and opened conditions. A main circuit has feed and return paths for flow of hydraulic fluid from a reservoir to the plunger and a pump interposed in the feed path and driven by the engine. A breather circuit has feed and return paths for flow of hydraulic fluid from an accumulator to the plunger. A control valve interposed in the feed and return paths of the respective main and breather circuits is actuatable by a piezoelectric valve for switching each of the main and breather circuits between pressure supply and return flow modes with respect to the plunger. The main circuit when switched to its pressure supply mode applies a drive pressure to the plunger which varies proportionally with the speed of the engine to accelerate the plunger along a drive stroke to move the valve form its closed toward its opened condition. The breather circuit allows pressure relief when the plunger has moved a portion of its total stroke. A chamber containing a gas is connected in flow communication with the pump via a piston to provide a variable pressure spring for applying a return pressure to the plunger which varies proportionally with engine speed, opposes but is less than the drive pressure and causes deceleration and return of the plunger to its initial position when main and breather circuits are in return flow modes.

16 Claims, 1 Drawing Figure

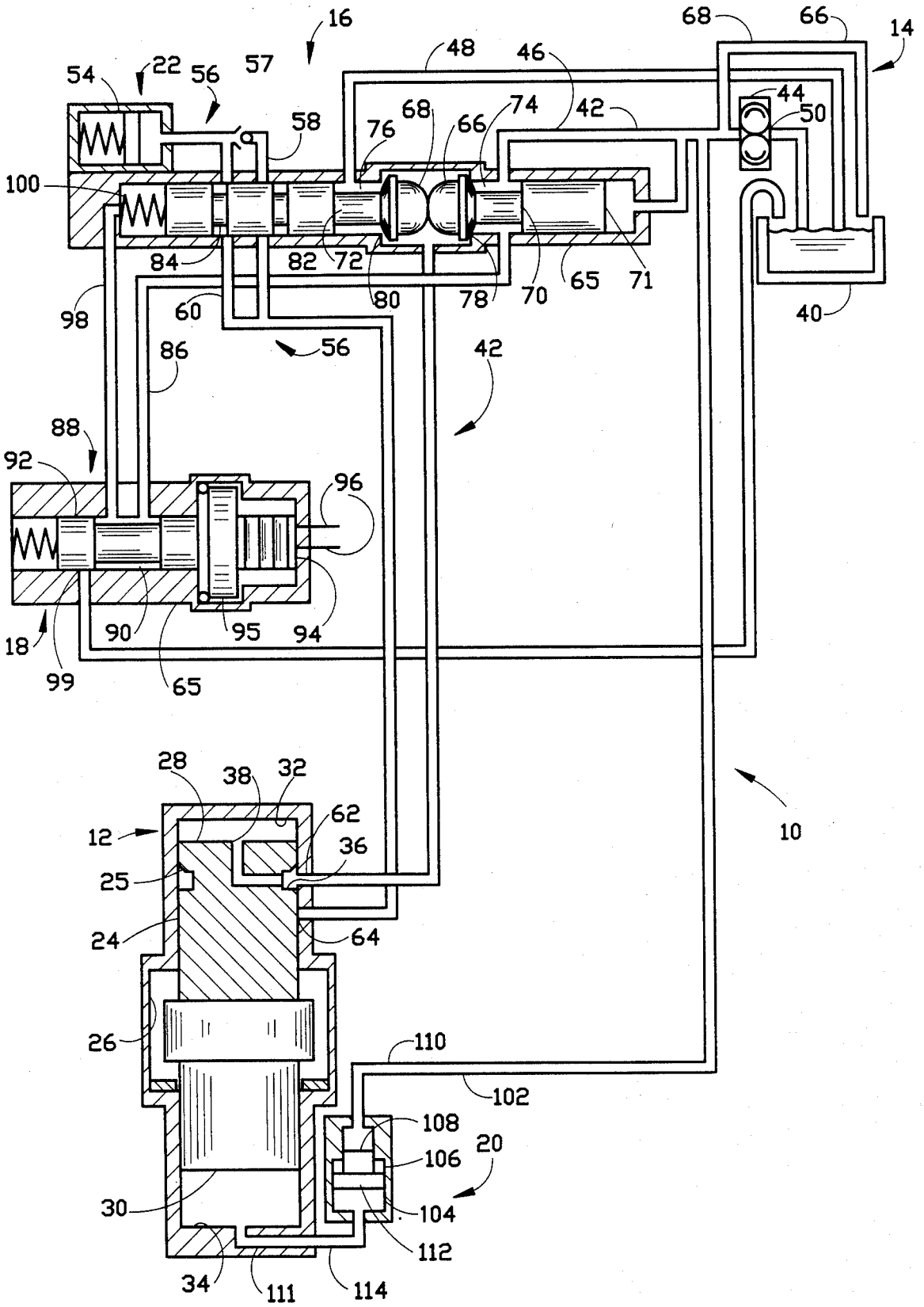
16
68
66
14
48
46
54
22
56
57
44
50
42
58
76
68
66
74
100
84
82
72
80
78
70
65
71
40
98
60
86
56
42
88
92
96
18
90
95
94
99
65
28
38
32
62
12
36
10
25
24
64
26
110
102
108
106
20
30
104
112
34
111
114

HYDRAULIC VALVE-OPERATING SYSTEM FOR INTERNAL COMBUSTION ENGINES

BACKGROUND OF THE INVENTION

1. Field of the Invention

The present invention relates generally to internal combustion engines and, more particularly, is concerned with hydraulic operating system for opening and closing a valve of an internal combustion engine.

2. Description of the Prior Art

Mechanical mechanisms by which the valves of an internal combustion engine are operated to take air or a fuel-air mixture into the cylinders of the engine and discharge the products of combustion from the cylinders are well known. In most four-stroke engines, the valve is of the inwardly-opening poppet type with its head being held against a seat in the cylinder head when the valve is closed and displaced toward the engine piston within the cylinder when the valve is opened.

Typically, the mechanical mechanism for operating each valve includes a camshaft driven off the engine crankshaft and having a cam thereon matched with each valve. Also, a linkage of the mechanism composed of a cam follower, push rod and rocker arm is associated with each cam for translating its rotary motion to reciprocatory motion to drive the corresponding valve between closed and opened conditions. In addition, a compressed helical spring is provided surrounding and engaged with the end of the valve opposite to its head for biasing the valve toward its seat.

After the cam accelerates the valve via the linkage toward the piston, the spring must be capable of decelerating the valve and then return it to the closed seated condition. In order to accomplish this, each spring must be strong enough to overcome the inertia of the linkage and the valve as well as to hold the cam follower on the cam at all times when running the engine at high speed. At such speed and load, the proportion of total engine output used to compress the spring is small. However, when running the engine at low speed with low load, the proportion of the total engine output used just to compress the spring is significantly higher. This requirement of conventional mechanical valve-operating mechanisms constitutes a major obstacle to improvement of fuel economy at engine idle and cruise speed and load conditions.

Consequently, a need exists for a fresh approach to operation of internal combustion engine valves which will avoid the aforementioned obstacle, without introducing a new one in its place, and will lead to improved fuel economy.

SUMMARY OF THE INVENTION

The present invention provides a hydraulic valve-operating system designed to satisfy the aforementioned needs. The hydraulic system of the present invention eliminates the mechanical force-transmitting components of the above-described conventional mechanical valve-operating mechanism. Instead, the system introduces hydraulic components which generate pressure in response and proportional to engine speed which respectively accelerate the valve to its opened condition and decelerate and return the valve to its closed condition. By using the hydraulic approach of the present invention, as opposed to the conventional mechanical approach, the level of valve return pressure required can now be balanced or matched with the level of valve driving pressure used in engine operation at any speed and load conditions so that a significant reduction in parasitic power losses can be achieved. This results in significant improvement of engine operating efficiency at idle and cruise speed and load conditions, for example up to five percent or more.

Accordingly, the present invention is directed to hydraulic valve-operating system for use in an internal combustion engine, comprising: (a) means movable between initial and displaced positions for moving a valve of an internal combustion engine between closed and opened conditions; (b) primary hydraulic fluid means connected in flow communication with the valve-moving means; (c) control means actuatable between first and second displaced positions for switching the primary hydraulic fluid means between pressure supply and return flow modes with respect to the valve-moving means wherein a drive pressure is respectively applied to and removed from the valve-moving means; (d) the primary hydraulic fluid means when switched to its pressure supply flow mode by the control means being driven by the engine for applying the drive pressure to the valve-moving means which varies as the square (2nd power) of the speed of the engine to accelerate the valve-moving means from its initial position toward its displaced position; (e) actuator means for actuating the control means between its first and second displaced position; and (f) spring means (which may be a gas spring) connected in flow communication with the primary hydraulic fluid means for applying a return pressure to the valve-moving means which opposes the drive pressure, the return pressure varying as the square (2nd power) of the speed of the engine but being initially less than the drive pressure, the application of the return pressure causing deceleration of the valve-moving means and return thereof to the initial position when the control means is placed in its return flow mode.

More particularly, the valve-moving means is a reciprocally-mounted plunger movable between the initial and displaced positions for moving the valve between closed and opened conditions. The plunger has first and second spaced-apart end surfaces and a port connected in flow communication with the first end surface. The primary hydraulic fluid means includes a hydraulic fluid reservoir, a main fluid-transmitting circuit defining a feed path for the flow of hydraulic fluid from the reservoir to the port of the plunger and a return path for the flow of hydraulic fluid from the port of the plunger to the reservoir, and a hydraulic fluid pump disposed in the feed path of the main circuit and having suction and pressure ports, the suction port of the pump being in flow communication with the reservoir, the delivery port communicating with a fixed orifice which spills hydraulic fluid back to the reservoir, the pump being driven by the engine to pump fluid from the reservoir through the fixed orifice and the feed path of the main circuit at the drive pressure which varies as the square of the speed of the engine. The pump is a constant displacement type and it is driven at engine speed. Consequently as the engine speed rises, pump volumetric flow increases in direct proportion to engine speed and pressure at the delivery port increases in proportion to (engine speed)$^2$ in order to permit the orifice flow and the pump flow to equilibrate.

The hydraulic system further includes auxiliary means connected in flow communication with the plunger for allowing relief of the drive pressure and deceleration of the plunger after the latter has moved through a predetermined proportion of the distance from its initial to displaced position. In particular, the auxiliary means includes a slot that occludes the main fluid supply port 62, at the predetermined proportion of the distance from initial to displaced portion, a hydraulic fluid accumulator, and a breather fluid-transmitting circuit defining a feed port 64 for the flow of hydraulic fluid from the accumulator to the breather port of the plunger so that after cutting off the drive pressure fluid may be supplied to fill the actuating volume when the plunger is being decelerated by the spring means. After the plunger has achieved zero velocity, the check valve 57 prevents return of the plunger 24. When the control means is returned to its first position by an electrical signal a return path for the flow of hydraulic fluid from the port of the plunger to the accumulator is opened permitting return of the plunger toward its initial position by the spring means, flow occurring through ports 36, 64 and slot 84 in the control means until the predetermined position in the stroke whereupon port 64 is occluded and port 62 opens. Further return of plunger causes flow to occur through port 62, line 42, past valve 72, orifice 49 to reservoir 40.

The control means in being actuatable between its first and second displaced positions also switches the auxiliary means between pressure relief supply and return flow modes with respect to the plunger wherein the drive pressure relief is respectively applied to and removed from the plunger. Specifically, the control means is a reciprocally-mounted hydraulic fluid flow control valve movable between first and second displaced positions and being interposed in the feed and return paths of the mai2n circuit between the pressure port of the pump and the main port 62 of the valve moving means. The flow control valve also is interposed in the feed and return paths of the breather circuit between the accumulator and the port of the plunger. The flow control valve when in its first displaced position opens the main and breather circuit feed paths, while closing the main and breather circuit return paths. The flow control valve when in its second displaced position opens the main and breather circuit return paths, while closing the main and breather circuit feed paths.

Still further, the actuator means includes a reciprocally-mounted selector valve coupled in flow communication with the pressure port of the pump and the flow control valve and being operable for actuating the flow control valve between its first and second displaced positions, and a piezoelectric valve for operating the selector valve. Furthermore, the spring means includes a chamber coupled in flow communication with the second end surface of the plunger and containing a quantity of a gas therein. The spring means also includes a piston reciprocally-mounted in the chamber and having one end portion coupled in flow communication with the pressure port of the pump in parallel with the main circuit feed path and an opposite end portion acting on the quantity of gas in the chamber for applying the return pressure to the second end surface of the plunger.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWING

In the course of the following detailed description, reference will be made to the attached drawing in which the single FIGURE contained therein is a schematical representation of the hydraulic system of the present invention for operating an internal combustion engine valve between opened and closed conditions.

DETAILED DESCRIPTION OF THE INVENTION

Referring now to the single FIGURE of the drawing, there is shown a preferred embodiment of the hydraulic valve-operating system of the present invention, being generally designated by the numeral 10. The hydraulic system 10 useful in operating each valve (not shown) of an internal combustion engine (not shown) basically includes a valve-moving means 12, primary hydraulic fluid means 14, hydraulic fluid flow control means 16, actuator means 18, spring means 20 and auxiliary hydraulic fluid means 22.

The valve-moving means 12 includes a plunger 24 mounted for reciprocal movement within a cavity 26. The plunger 24 has spaced-apart opposite end surfaces 28, 30 which are spaced from corresponding opposite ends 32, 34 of the cavity 26 when the plunger 24 is at both of its extreme initial and displaced positions, as respectively seen in solid and dashed line form in the FIGURE. Movement of the plunger 24 between its initial and displaced positions moves one of the engine valve (not shown) between closed and opened conditions. The plunger 24 also has a port 36 connected in flow communication by a channel 38 with the one end surface 28.

The primary hydraulic fluid means 14 of the fluidic system 10, which is connected in flow communication with the plunger 24, includes a hydraulic fluid reservoir 40, a main fluid-transmitting circuit 42 and hydraulic fluid pump 44. The main circuit 42 defines a feed path 46 for the flow of hydraulic fluid from the reservoir 40 to the port 36 of the plunger 24 and a return path 48 for the flow of hydraulic fluid from the plunger port 36 back to the reservoir 40. The hydraulic fluid pump 44 has suction and pressure ports 50, 52 and is disposed in the main circuit feed path 46 with its suction port 50 connected in flow communication with the reservoir 40. The pump 44 is of a constant displacement type. It is driven in a conventional manner by the engine (not shown) to pump fluid from the reservoir 40 through the main circuit feed path 46 and to a pressure relief channel 66 containing a fixed orifice 68. As engine speed varies in proportion to the (speed of the engine)$^2$ since the orifice flow and the pump flow must be equal.

The auxiliary hydraulic fluid means 22 of the hydraulic system 10 in connected in flow communication with the port 36 of the plunger 24 for allowing deceleration of the plunger after the latter has moved through a predetermined proportion of the distance from its initial to displaced position without causing correlation of the volume adjacent face 28 on consumption of drive energy in undesirably filling the volume with pressurized fluid. The auxiliary means 22 includes a hydraulic fluid accumulator 54 and a breather fluid-transmitting circuit 56. The breather circuit 56 defines a feed path 58 for the flow of hydraulic fluid from the accumulator 54 to the plunger port 36 when the control means is in its first position and a return path 60 for the flow of hydraulic fluid from the plunger port back to the accumulator when the control means assumes its second position. Therefore, after the plunger 24 moves on its drive stroke beyond a predetermined proportion of the distance from its initial solid line position to its dashed line position, for example one-third of this total stroke, its port 36 moves out of communication with a main port 62 of the main circuit feed path 42, 46 and into a communication with a breather port 64 of the breather circuit feed path 56, 58. Thus, the supply of drive pressure to the plunger 24 by the pump 44 is cut off after one-third of the stroke and fluid flow is thereafter provided by the accumulator 54 for the remainder of the stroke allowing deceleration of the plunger 24 (as will be explained later) without consumption of drive energy.

The reciprocally-mounted hydraulic fluid flow control means 16 is in the form of a spool valve being interposed in the main circuit feed and return paths 46, 48 between the pressure port 52 of the pump 44 and the port 36 of the plunger 24 and in the breather circuit feed and return path 58, 60 between the accumulator 54 and the plunger port 36. The control valve 16 is movable between left and right displaced positions, by the actuator means 18 which will be described later on.

More particularly, the control valve 16 is mounted in a structure 65 and has a pair of tandemly-arranged right and left valve heads 66, 68 defined in its right half with reduced diameter stem portions 70, 72 defining right and left annular recesses 74, 76 on oppositely-facing side of the heads. The main circuit feed and return paths 46, 48 are connected in communication respectively with right and left recesses 74, 76 surrounding the stem portions 70, 72. On the one hand, the right and left valve heads 66, 68 respectively close an open right and left valve seats 78, 80 on the structure 65, and thereby close and open the main circuit feed and return paths 46, 48 when the valve 16 is located at its right displaced position (2nd position), as seen in the FIGURE. On the other hand, the opposite is true when the valve 16 is at its left displaced position (first position), that is, the right and left valve heads 66. 68 respectively open and close right and left valve seats 78, 80 and thereby open and close the main circuit feed and return paths 46, 48 to the port 62.

Still further, the valve 16 has a pair of axially-spaced annular grooves 82, 84 formed in its left half. On the one hand, the right and left grooves 82, 84 are respectively offset from and aligned with the breather circuit feed and return paths 58, 60 to respectively close and open the same when the valve 16 is disposed in its right displaced position, as seen in the FIGURE. On the other hand, when the valve 16 is disposed in its left displaced position, the opposite is true, that is, the right and left grooves 82, 84 are respectively aligned with and offset from the breather circuit feed and return paths 58, 60 to open and close the same.

The actuator means 18 of the hydraulic system 10, being coupled by a flow path 86 in flow communication with the right annular recess 74 and thereby with the pressure port 52 of the pump 44, is operable for actuating the flow control valve 16 between its right and left displaced positions. In particular, the actuator means 18 includes a selector valve 88 reciprocally-mounted in the structure 65 and coupled in flow communication with the pump pressure port 52 via the flow path 86. The selector valve 88 has a central annular recess 90 defined about its stem 92 which is connected at one end to a suitable actuator such as a piezoelectric-operated (pz) actuator 94. Suitable electrical signals timed with rotation of the crankshaft of the engine is a known manner are fed on conductors 96 to the pz actuator 94 to cause reciprocation of piston 95 and corresponding reciprocation of the selector valve stem 92 with amplitude of displacement amplified by the ration of piston 95 area/-stem 92 area to the left when energized and right when deenergized. On the one hand, movement of the selector valve stem 92 to the left by the pz actuator 94 offsets the recess 90 from the flow path 86 and closes off communication of the latter with a flow path 98 which communicates with the left end of the spool valve 16 simultaneously opening communication between flow path 98 and vent port 99 leading back to reservoir 40. On the other hand, movement of the selector valve stem 92 to the right by the pz actuator 94, as seen in the FIGURE, places the recess 90 in alignment with the flow path 86 occluding port 99 and thus connecting flow path 86 with the flow path 98 communicating with the left end of the valve 16.

When the pz actuator 94 is electrically deenergized the selector valve stem 92 is permitted to return to its right position, as seen in the FIGURE, by the pressure of a spring 100 at the left end of the spool valve 16 since hydraulic pressure is equally applied to identical area at both right and felt extremities of the tandemly arranged valves 71, 73. In this condition the accumulator 54 is refilled by discharge of fluid from the chamber above plunger 24 until port 64 is occluded and thereafter discharge occurs through port 62, channel 42, valve seat 80 adjustable orifice 49 channel 48 to reservoir 40. The area of orifice 49 is adjusted to give equal discharge time to charge time. However, when the selector valve stem 92 is actuated to its left position, the hydraulic fluid pressure is cutoff from the left end of the valve 16 and vented to port 99, the hydraulic pressure at the right end of the valve is sufficient to overcome the restoring force of the spring 100, causing the valve 16 to be moved rapidly to its left displaced position.

Finally, the hydraulic system 10 includes the spring means 20 which acts on the opposite end surface 30 of the plunger 24 to decelerate and when appropriately commanded by operation of the control valve means 16, to return the plunger 24 to its initial position, seen in the FIGURE. The spring means 20 is coupled in flow communication with the pressure port 52 of the pump 44 by a flow path 102 in parallel with the main circuit feed path 46 for applying a return pressure to the end surface 30 of the plunger 24, which return pressure because of the composition of the spring means 20 is initially less than the drive pressure applied to the other end surface 28 of the plunger but rapidly rises relative to drive pressure after plunger 24 occludes port 62 and opens port 64. However, like the drive pressure, the initial return pressure is responsive, and varies in proportion, to the (engine speed)$^2$.

While the spring means 20 can be any suitable arrangement which applies a return pressure to the plunger 24 responsive and proportional to the (engine speed)$^2$, in one preferred embodiment the spring means 20 includes a chamber 104 interposed in the flow path 102 in flow communication with the end surface 30 of the plunger 24 and with the pressure port 52 of the pump 44. The chamber 104 contains a quantity of a gas, such as nitrogen, and a piston 106 is reciprocally-mounted in the chamber in a free floating relationship. The piston 106 has one end portion 108 coupled in flow communication with pump pressure port 52 so as to interface with hydraulic fluid under pressure. A flow restrictor 110 in the hydraulic fluid flow path 102 upstream of the chamber 104 and piston 106 ensures that the pressure of the hydraulic fluid applied to the one end portion 108 of the piston 106 is less than that imposed as the drive pressure on the end surface 28 of the plunger 24. In addition, the piston 106 has an opposite end portion 112 which acts on the quantity of nitrogen gas in the chamber 104 to compress the same and apply the return pressure to the end surface 30 of the plunger 24. The opposite end portion 112 of the piston 106 is larger in diameter than the initial return pressure is smaller than the drive pressure. However, the initial return pressure still varies as (engine speed)$^2$. When plunger 24 is displaced under the pressure of the drive fluid applied to face 28 the gas pressure applied to face 30 will rise under the relationship of the gas laws and therefore depends upon the initial pressure and the initial volume of gas exposed to piston 112. The pressure on face 30 of the plunger will rise more rapidly by the optional employment of an orifice restrictor 111 in duct 114. This will be effective at high speed but not low speed. The spring means 20 may be applied to two or more valve moving means simply by coupling several ducts 114 to the gas pressure chamber under piston 112.

To recap, the flow control valve 16 is actuated to its left displaced position at the start of each cycle by a command issued in response to the rotational position of the crankshaft. Hydraulic fluid is pumped by the pump 44 at a pressure proportional to (engine speed)$^2$, for example up to maximum of 600 psi. The hydraulic fluid is fed in the main circuit feed path 46 through the right annular recess 74 and right valve seat 78 from the pressure port 52 of the pump 44 to the end surface 28 of the plunger 24 via its port 36 and the main port 62 until the plunger 24 has been accelerated from its initial position to an intermediate position, such as one-third of the total stroke distance between its initial and displaced positions. Upon reaching the intermediate position, the port 36 of the plunger 24 breaks communication with the main port 62 and makes communication with the breather port 64. (The breather circuit feed path 58 is also open via the right annular groove 82 when the control valve 16 is in its left displaced position.) The end surface 28 of the plunger 24 is now brought into communication with the accumulator 54 which contains hydraulic fluid at a much lower pressure so that the drive pressure is shut off but hydraulic fluid is still allowed to flow into the space between the faces 28 and 32 so that the plunger continues on its forward stroke under its own inertia. To avoid the plunger 24 stalling after its initial movement when the engine is at idling speed, a small angle of taper is applied above the top edge of the slot 36. This taper will ensure that some driving fluid from channel 42 continues to feed at a low rate to the top of the plunger 24. If plunger 24 is moving rapidly the leakage will be insignificant.

However, concurrently the return pressure being generated by the spring means 20 has sharply increased as dictated by the classical gas laws and, with relief of the drive pressure, the increasing return pressure is now sufficient to cause rapid deceleration of the plunger 24. During this time, the actuator means 18 is shifted by a command issued in response to the rotational position of the engine crankshaft to cause the control flow valve 16 to assume its right displaced position. Now main circuit return path 48 is open via the left annular recess 76 and left valve seat 80 of the control valve 16 (and the breather circuit return path 60 is open via the left annular groove 84 of the valve). As the plunger 24 is returned to its initial position via action of the nitrogen pressurized gas spring, hydraulic fluid first flows back to the accumulator 54 via the breather port 64 and then to the reservoir 40 via the main port 62.

It is thought that the fluidic valve-operating system of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A hydraulic valve-operating system for use in an internal combustion engine, comprising:

(a) means movable between initial and displaced positions for moving a valve of an internal combustion engine between closed and opened conditions;

(b) primary hydraulic fluid means connected in flow communication with said valve-moving means;

(c) control means actuatable between first and second displaced positions for switching said primary hydraulic fluid means between pressure supply and return flow modes with said valve-moving means wherein said first pressure is respectively applied to and removed from said valve-moving means;

(d) said primary hydraulic fluid means, when switched to its pressure supply flow mode by said control means, being driven by the engine for applying a first pressure to said valve-moving means which varies proportionally with the (speed of the engine)$^2$ to accelerate said valve-moving means from its initial position toward its displaced position;

(e) actuator means for actuating said control means between its first and second displaced positions; and (f) gas spring means connected in flow communication with said primary hydraulic fluid means for applying a second pressure to said valve-moving means which opposes said first pressure, said second pressure varying proportionally with the (speed of the engine)$^2$ but being initially less than said first pressure, the application of said second pressure causing deceleration of said valve-moving means and return thereof to said initial position when said control means is in its return flow mode.

2. The hydraulic system as recited in Claim 1, further comprising:

auxiliary means connected in flow communication with said valve-moving means for occluding application of said first pressure and supply of low pressure fluid while the valve-moving means is being decelerated after the latter has moved through a predetermined proportion of the distance from its initial to displaced position.

3. The hydraulic system as recited in claim 2, wherein control means in being actuatable between its first and second displaced positions also switches said auxiliary means between pressure relief supply and return flow modes with said valve-moving means wherein said first pressure relief is respectively applied to and removed from said valve-moving means.

4. The hydraulic system as recited in claim 1, wherein said valve-moving means is a reciprocally-mounted plunger movable between said initial and displaced positions for moving the valve between closed and opened conditions, said plunger having first and second spaced-apart end surfaces and a port connected in flow communication with said first end surface.

5. The hydraulic system as recited in claim 4, wherein said primary hydraulic fluid means includes:

a hydraulic fluid reservoir;

a main fluid-transmitting circuit defining a feed path for the flow of hydraulic fluid from said reservoir to said port of said plunger and a return path for the flow of hydraulic fluid from said port of said plunger to said reservoir; and a hydraulic pump disposed in said feed path of said main circuit and having suction and pressure ports, said suction port of said pump being in flow communication with said reservoir, said pump being driven by the engine to pump fluid from said reservoir through said feed path of said main circuit at said first pressure which varies in proportion to the (speed of the engine)$^2$.

6. The hydraulic system as recited in claim 5, further comprising:

auxiliary means connected in flow communication with said plunger for allowing relief of said first pressure and deceleration of said plunger after the latter has moved through a predetermined proportion of the distance from its initial to displaced position.

7. The hydraulic system as recited in claim 6, wherein said auxiliary means includes:

a hydraulic fluid accumulator; and a breather fluid-transmitting circuit defining a feed path for the flow of hydraulic fluid from said accumulator to said port of said plunger for relief of said first pressure and deceleration of said plunger by said spring means and a return path for the flow of hydraulic fluid from said port of said plunger to said accumulator upon return of said plunger toward its initial position by said spring means.

8. The hydraulic system as recited in claim 7, wherein control means in being actuatable between its first and second displaced positions also switches said auxiliary means between pressure relief supply and return flow modes with said valve-moving means wherein said first pressure relief is respectively applied to and removed from said plunger.

9. The hydraulic system as recited in claim 8, wherein said control means is reciprocally-mounted hydraulic fluid flow control valve-movable between first and second displaced positions and being interposed in said feed and return paths of said main circuit between said pressure port of said pump and said port of said plunger, said flow control valve also being interposed in said feed and return paths of said breather circuit between said accumulator and said port of said plunger, said flow control valve when in its first displaced position opening said main and breather circuit feed paths while closing said main and breather circuit return paths, said flow control valve when in its second displaced position opening said main and breather circuit return paths while closing said main and breather circuit feed paths.

10. The hydraulic system as recited in claim 9, wherein said actuator means includes:

a reciprocally-mounted selector valve couple in flow communication with said pressure port of said pump and said flow control valve and being operable for actuating said flow control valve between its first and second displaced positions; and a piezoelectric valve for operating said selector valve.

11. The hydraulic system as recited in claim 9, wherein said spring means includes:

a chamber couple in flow communication with said second end surface of said plunger and containing a quantity of a gas therein; and a piston reciprocally-mounted in said chamber and having one end portion couple in flow communication with said pressure port of said pump in parallel with said feed path of said main circuit and an opposite end portion acting on said quantity of gas in said chamber for applying said second pressure to said second end surface of said plunger.

12. A hydraulic valve-operating system for use in an internal combustion engine, comprising:

(a) a reciprocally-mounted plunger movable between initial and displaced positions for moving a valve between closed and opened conditions, said plunger having first and second spaced-apart end surfaces and a port connected in flow communication with said first end surface;

(b) a hydraulic fluid reservoir;

(c) a main fluid-transmitting circuit defining a feed path for the flow of hydraulic fluid from said reservoir to said port of said plunger and a return path for the flow of hydraulic fluid from said port of said plunger to said reservoir;

(d) a hydraulic fluid accumulator;

(e) a breather fluid-transmitting circuit defining a feed path for the flow of hydraulic fluid from said accumulator to said port of said plunger and a return path for the flow of hydraulic fluid from said port of said plunger to said accumulator;

(f) a hydraulic fluid pump disposed in said feed path of said main circuit and having suction and pressure ports, said suction port of said pump being in flow communication with said reservoir, said pump being driven by the engine to pump fluid from said reservoir through said feed path of said main circuit and through the fixed orifice to a return path to said fluid reservoir so that drive pressure varies in proportion to the (speed of the engine)$^2$;

(g) a reciprocally-mounted hydraulic fluid flow control means movable between first and second displaced positions and being interposed in said feed and return paths of said main circuit between said pressure port of said pump and said port of said plunger, said flow control means also being interposed in said feed and return paths of said breather circuit between said accumulator and said port of said plunger, said flow control means when in its first displaced position opening said main and breather circuit feed paths while closing said main and breather circuit return paths, said flow control means when in its second displaced position opening said main and breather circuit return paths while closing said main and breather circuit reed paths;

(h) actuator mean coupled in flow communication with said pressure port of said pump and said flow control means and being operable for actuating said flow control means between its first and second displaced positions; and (i) spring means acting on said second end surface of said plunger and coupled in flow communication with said pressure port of said pump in parallel with said feed path of said main circuit for applying a return pressure, which is less than said drive pressure, to said second end surface of said plunger which is responsive, and varies in proportion, to the (speed of the engine)$^2$;

whereby hydraulic fluid under said drive pressure is fed in said main circuit feed path from said pressure port of said pump to said first end surface of said plunger when said flow control means is at its first displaced position and said port of said plunger is disposed in flow communication with said main circuit feed path as said plunger moves from its initial position to an intermediate position defined between its initial and displaced positions for driving said plunger on a drive stroke from its initial position toward its displaced position, whereas drive pressure is relieved and hydraulic fluid is allowed to flow in said main circuit return path from said first end surface of said plunger via its port to said reservoir when said flow control means is at its second displaced position and said port of said plunger is disposed in flow communication with said main circuit feed path as said plunger moves from its intermediate position to its initial position for allowing return of said plunger due to return pressure being applied to said second end surface thereof by said spring means.

13. The hydraulic system as recited in claim 12, wherein said flow control means includes a reciprocally-mounted hydraulic fluid flow control valve movable between first and second displaced positions and being interposed in said feed and return paths of said main circuit between said pressure port of said pump and said port of said plunger, said flow control valve also being interposed in said feed and return paths of said breather circuit between said accumulator and said port of said plunger, a flow restrictor interposed said spring means and said second end surface of said plunger to achieve higher gas pressure applied to face 30 under rapid movements of said plunger, said flow control valve when in its first displaced position opening said main and breather circuit feed paths while closing said main and breather circuit return paths, said flow control valve when in its second displaced position opening said main and breather circuit return paths while closing said main and breather circuit feed paths.

14. The hydraulic system as recited in claim 12, wherein said actuator means includes:

a reciprocally-mounted selector valve coupled in flow communication with said pressure port of said pump and said flow control valve and being operable for actuating said flow control valve between its first and second displaced positions; and a piezoelectric actuator for operating said selector valve.

15. The hydraulic system as recited in claim 12, wherein said spring means includes:

a chamber coupled in flow communication with said second end surface of said plunger and containing a quantity of a gas therein; and a piston reciprocally-mounted in said chamber and having one end portion coupled in flow communication with said pressure port of said pump in parallel with said feed path of said main circuit and an opposite end portion acting on said quantity of gas in said chamber for applying said second pressure to said second end surface of said plunger.

16. The hydraulic system as recited in claim 15, wherein said opposite end portion of said piston is larger in diameter than said one end portion thereof such that said return pressure is smaller than said drive pressure while both said second and first pressures vary proportionally to the speed of the engine.

* * * * *